US009546657B2

(12) United States Patent
Lee et al.

(10) Patent No.: US 9,546,657 B2
(45) Date of Patent: Jan. 17, 2017

(54) COMPRESSOR HAVING A LOWER FRAME AND A METHOD OF MANUFACTURING THE SAME

(71) Applicant: LG ELECTRONICS INC., Seoul (KR)

(72) Inventors: Kiuk Lee, Seoul (KR); Suchul Kim, Seoul (KR); Nara Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/827,798

(22) Filed: Aug. 17, 2015

(65) Prior Publication Data

US 2015/0354568 A1 Dec. 10, 2015

Related U.S. Application Data

(62) Division of application No. 13/949,350, filed on Jul. 24, 2013, now Pat. No. 9,429,157.

(30) Foreign Application Priority Data

Mar. 18, 2013 (KR) ..... 10-2013-0028787

(51) Int. Cl.
*F04C 18/00* (2006.01)
*F04C 18/02* (2006.01)
*F04C 23/00* (2006.01)

(52) U.S. Cl.
CPC ..... *F04C 18/00* (2013.01); *F04C 18/0215* (2013.01); *F04C 23/008* (2013.01); *F04C 2230/60* (2013.01); *F04C 2230/603* (2013.01); *F04C 2240/30* (2013.01); *Y10T 29/4924* (2015.01); *Y10T 29/49242* (2015.01)

(58) Field of Classification Search
CPC ..... F04C 18/0215; F04C 2230/603; F04C 2240/30; F04C 2230/60; F04C 2230/604; Y10T 29/4924; B23P 15/00; B23P 6/002; B23P 6/005; B23P 6/007; B23P 6/04; B23P 6/045; F04B 39/14; F04B 43/06

(Continued)

(56) References Cited

U.S. PATENT DOCUMENTS 6,560,868 B2 5/2003 Milliff et al.
6,682,327 B2 1/2004 Milliff et al.

(Continued)

FOREIGN PATENT DOCUMENTS

CN 1029867 C 9/1995
CN 101354042 A 1/2009

(Continued)

OTHER PUBLICATIONS

Chinese Office Action issued in Application No. 201410098928.8 dated Dec. 3, 2015.

(Continued)

*Primary Examiner* — Mary A Davis
(74) *Attorney, Agent, or Firm* — Ked & Associates, LLP

(57) ABSTRACT

A compressor having a lower frame and a method of manufacturing the same are disclosed. The compressor may include a cylindrical shell, a rotational shaft rotatably mounted in the cylindrical shell, a rotor and a stator that rotates the rotational shaft, a compression device driven by the rotational shaft, a lower bearing configured to rotatably support one side of the rotational shaft, a lower frame configured to support the lower bearing, the lower frame being configured to be press-fitted into a lower end portion of the cylindrical shell, and a base configured to seal the lower end portion of the cylindrical shell. The lower frame may include a main body configured to be press-fitted onto an inner circumferential surface of the cylindrical shell and a flange that extends from the main body, the flange being (Continued)

configured to limit a press-fit depth by contacting the lower end portion of the cylindrical shell.

20 Claims, 6 Drawing Sheets

(58) Field of Classification Search
USPC ..... 418/55.1–55.5
See application file for complete search history.

(56) References Cited

U.S. PATENT DOCUMENTS

| | | | |
|---|---|---|---|
| 2002/0182092 | A1 | 12/2002 | Milliff et al. |
| 2002/0192094 | A1 | 12/2002 | Milliff et al. |

FOREIGN PATENT DOCUMENTS

| | | | |
|---|---|---|---|
| JP | 04-350383 | A | 12/1992 |
| JP | 07-158577 | | 6/1995 |
| JP | 09-088848 | | 3/1997 |
| JP | 3070193 | U | 7/2000 |

OTHER PUBLICATIONS

Final Office Action issued in co-pending U.S. Appl. No. 13/949,350 dated Jan. 25, 2016.

U.S. Office Action issued in co-pending U.S. Appl. No. 13/949,350 dated Aug. 27, 2015.

Machine translation of JP 07-158577, published on Jun. 1995, Inventor: Morishima.

COMPRESSOR HAVING A LOWER FRAME AND A METHOD OF MANUFACTURING THE SAME

CROSS-REFERENCE TO RELATED APPLICATION(S)

This application is a Divisional application of U.S. patent application Ser. No. 13/949,350 filed on Jul. 24, 2013, which claims the benefit to Korean Application No. 10-2013-0028787 filed in Korea on Mar. 18, 2013, the contents of which are hereby incorporated by reference in their entirety.

BACKGROUND

1. Field

A compressor having a lower frame and a method of manufacturing the same are disclosed herein.

2. Background

Compressors having a lower frame are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Figure 1:
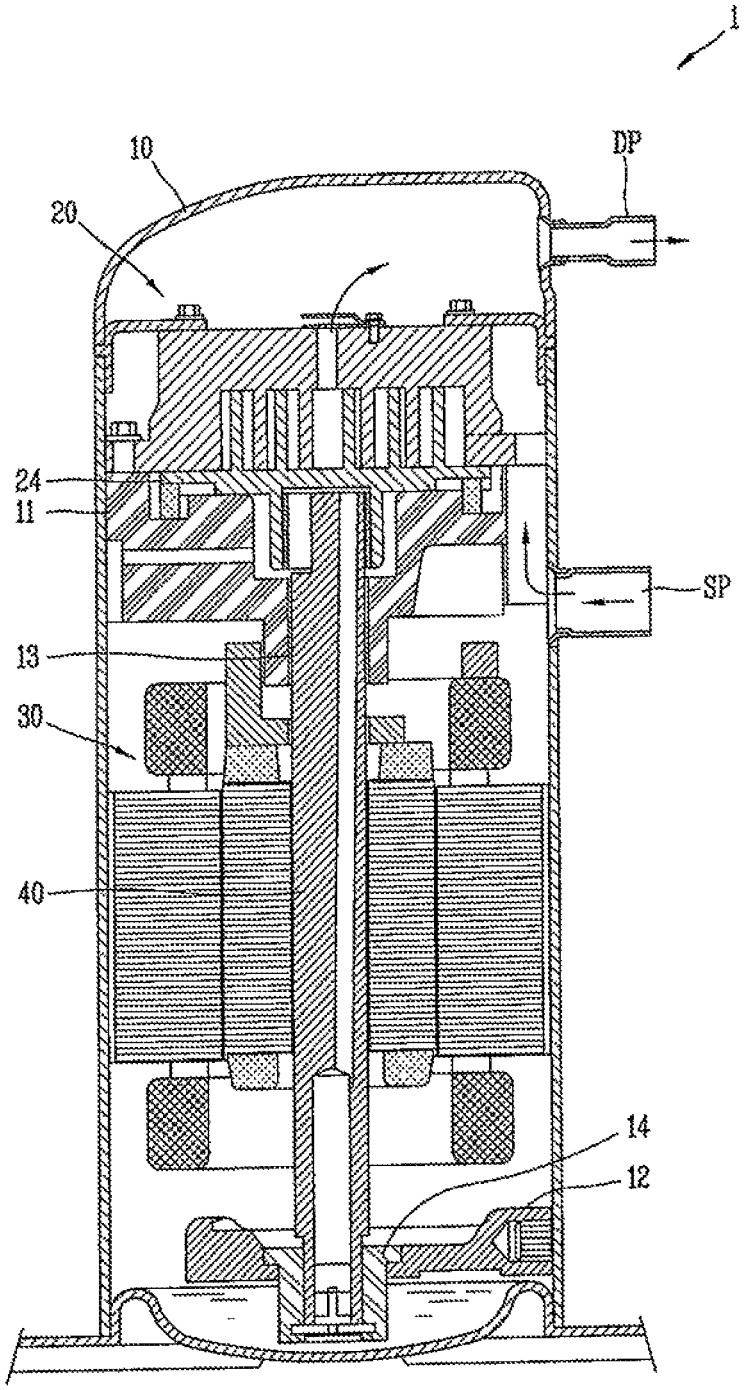
FIG. 1 is a cross-sectional view of a scroll compressor.

Description will now be given in detail of embodiments, with reference to the accompanying drawings. Where possible, like reference numerals have been used to indicate like elements, and repetitive disclosure has been omitted.

In general, a compressor includes a compression device in which a refrigerant is sucked, compressed, and discharged, and a rotational part to rotatably drive the compression device. Various types of compressors are used, categorized according to shape and a compression method of the compression device.

A scroll compressor refers to a compressor that utilizes a first or orbital scroll having spiral wrap and a second or fixed scroll having a spiral wrap, the first scroll that performing an orbital motion with respect to the second scroll. While the first scroll and the second scroll are engaged with each other in operation, a capacity of a pressure chamber formed therebetween may be reduced as the first scroll performs the orbital motion. Hence, a pressure of a fluid in the pressure chamber may be increased, and the fluid discharged from a discharge opening formed at a central portion of the second scroll.

The scroll compressor may perform a suction process, a compression process, and a discharge process consecutively while the first scroll performs the orbital motion. Because of operational characteristics, the scroll processor may not require a discharge valve and a suction valve in principle, and its structure is simple with a small number of components, thus making it possible to perform high speed rotation. Further, as the change in torque required for compression is small and the suction and compression processes consecutively performed, the scroll compressor is known to create minimal noise and vibration.

For the scroll compressor, an occurrence of leakage of a refrigerant between the first scroll and the second scroll should be avoided or kept at a minimum, and lubricity (lubrication characteristic) should be enhanced therebetween. In order to prevent a compressed refrigerant from leaking between the first scroll and the second scroll, an end of a wrap portion should be adhered to a surface of a plate portion. On the other hand, in order for the first scroll to smoothly perform an orbital motion with respect to the second scroll, resistance due to friction should be minimized. The relationship between prevention of the refrigerant leakage and enhancement of the lubricity is contradictory. That is, if the end of the wrap portion and the surface of the plate portion are adhered to each other with an excessive force, leakage may be prevented. However, in such a case, more friction between parts results, thereby increasing noise and abrasion. On the other hand, if the end of the wrap portion and the surface of the plate portion are adhered to each other with less than an adequate sealing force, friction may be reduced, but lowering of the sealing force may result in an increase of leakage.

Therefore, only when the first scroll orbits exactly in parallel to the second scroll, may a correct close adhesion of the components for the scroll compressor be achieved so as to reduce noise and abrasion. To this end, a rotational shaft to rotate the first scroll has to be concentrically installed with respect to a compressor casing. However, this may be one factor that makes it difficult to manufacture the scroll compressor.

FIG. 1 is a cross-sectional view of a scroll compressor. As shown in FIG. 1, the scroll compressor 1 of FIG. 1 may include a main frame 11, a casing 10 having a lower frame 12 fixed therein, a compression device 20 installed in an upper portion of the casing 10 to compress and discharge a refrigerant, and a rotational device 30 installed in a lower portion of the casing 10 to rotate the compression device 20. A rotational shaft 40 rotated by the rotational device 30 may be coupled to a first or orbital scroll 24 disposed in the compression device 20. The rotational shaft 40 may be installed to be concentric with the casing 10 by, for example, the use of bearings 13 and 14 disposed on the main frame 11 and the lower frame 12, respectively.

The lower frame 12 may be, for example, welded onto an inner wall of the casing 10, and the bearing 14 disposed on the lower frame 12 may be coupled to the lower frame 12 by, for example, bolts. A base may be, for example, welded onto the lower end portion of the casing 10 so as to seal the inside of the casing 10.

During the process of fixing the lower frame to the casing in a scroll compressor such as that shown in FIG. 1, the bearing 14 may be coupled to the lower frame 12. Afterwards, with the lower frame 12 inserted into the casing 10, an inner wall of the casing 10 and an outer circumferential portion of the lower frame 12 may be, for example, welded to each other. However, during this process, a gap may be generated between the casing 10 and the lower frame 12 due to thermal expansion caused by the welding. Consequently, the lower frame 12 may be biased (for example, inclined, unbalanced) to one side instead of being concentric with the casing.

Embodiments disclosed herein overcome such problems, by providing a compressor capable of facilitating an installation of a rotational shaft and a lower frame.

Figure 2:
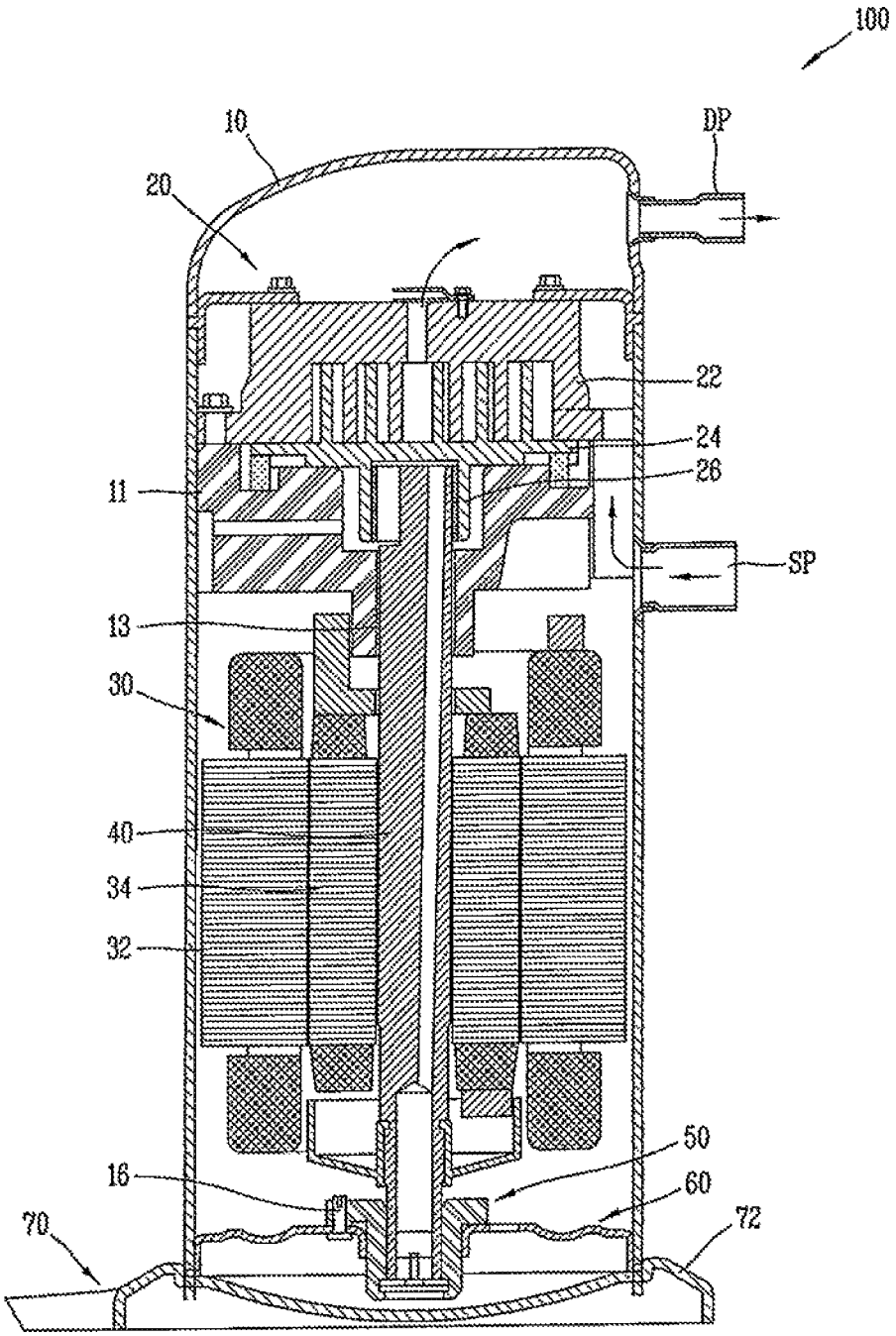
FIG. 2 a cross-sectional view of a compressor in accordance with an embodiment.
Figure 3:
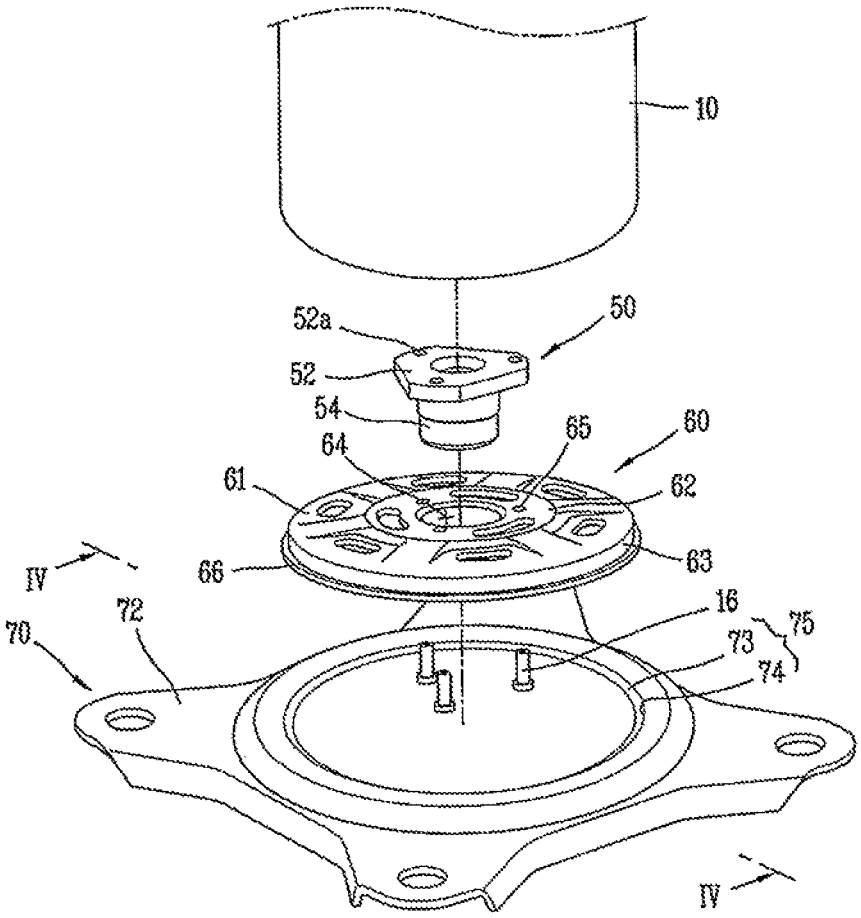
FIG. 3 is a disassembled perspective view showing a coupling structure of a shell, a lower frame, and a base of the compressor of FIG. 2.
Figure 4:
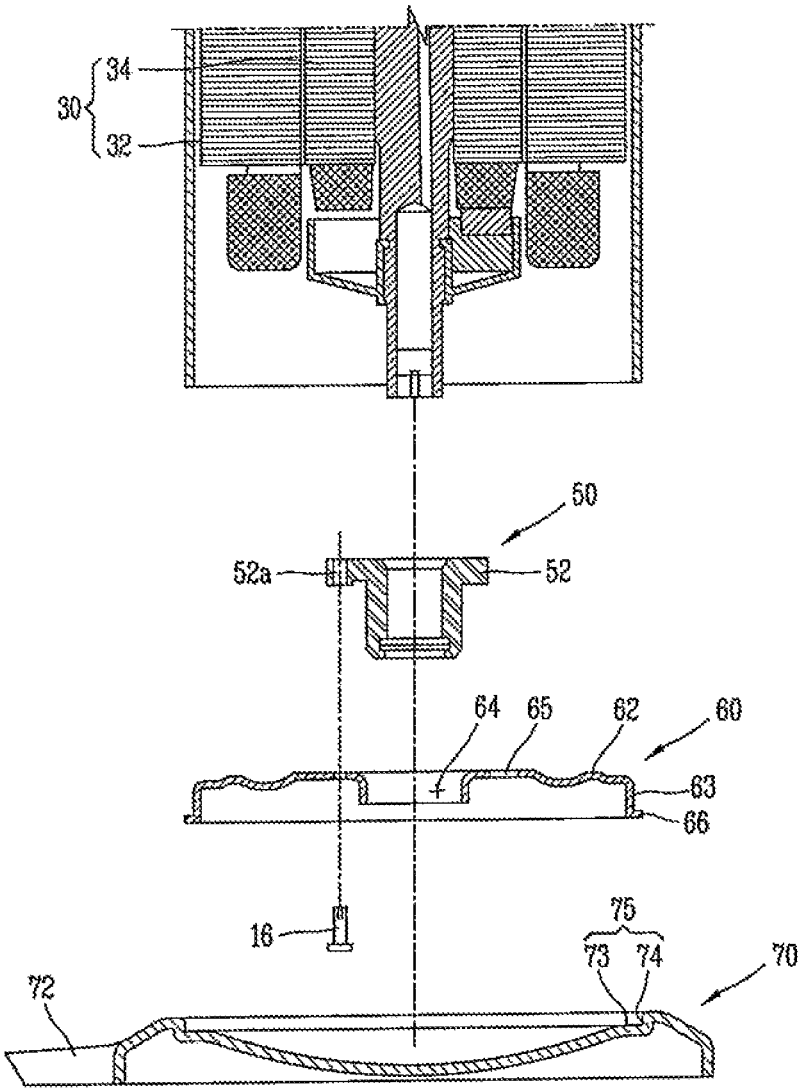
FIG. 4 is an enlarged cross-sectional view of FIG. 3, taken along line IV-IV.

FIG. 2 is a cross-sectional view of a compressor in accordance with an embodiment. FIG. 3 is a disassembled perspective view showing a coupling structure of a shell, a lower frame, and a base of the compressor of FIG. 2.

As shown in FIGS. 2 and 3, the compressor 100 may include a shell 10, which may be in a cylindrical shape. The shell 10 may include a discharge port DP, through which a compressed operating fluid may be discharged, and a suction port SP, through which the operating fluid may be sucked into the casing 10. A main frame 11 to support a compression device, which will be explained hereinbelow, may be disposed in the shell 10.

An upper bearing 3 that rotatably supports an upper portion of a rotational shaft 40, which is discussed hereinbelow, may be disposed at a lower portion of the main frame 11, and a compression device 20 may be supported on an upper side of the main frame 11. In more detail, the compression device 20 may include an orbital or first scroll 24 and a fixed or second scroll 22 supported on the main frame 11, the first scroll 24 executing an orbital motion on an upper surface of the main frame 11. A boss 26, in which an end portion of the rotational shaft 40 may be inserted, may be formed on a lower surface of the first scroll 24.

The rotational device 30 to rotate the rotational shaft 40 may be located below the main frame 11. The rotational device 30 may include a stator 32 fixed to an inner wall surface of the cylindrical shell 10, and a rotor 34 fixedly inserted onto the rotational shaft 40 and located inside the stator 32.

An upper end portion of the rotational shaft 40 may be supported by the upper bearing 13 of the main frame 11, and a lower end portion thereof may be supported by a lower bearing 50 located in a lower portion of the shell 10, as is discussed hereinbelow. The lower bearing 50 may be fixed onto a lower frame 60, which may be press-fitted into a lower end portion of the shell 10 using, for example, rivets 16.

Once the lower frame 60 is fixed onto the lower end portion of the shell 10, a base 70 may be, for example, welded onto the lower end portion of the shell 10. The base 70 may be provided with mounting portions 72 on its outer circumferential surface.

As shown in FIG. 3, the lower bearing 50 may be provided with a flange 52, which may have a triangular shape, disposed on an upper end portion thereof, and rivet insertion holes 52*a* may be formed along an outer circumferential surface of the flange 52. A bush 54 may extend from a lower surface of the flange 52 and may have a cylindrical shape. An inner surface of the bush 54 may contact the rotational shaft 40, so as to function as a bearing surface to minimize friction against the rotational shaft 40.

The lower frame 60 may include a main body 61 having an annular press-fit portion 63, which may be formed on or at an outer circumferential portion of a support plate 62. The support plate 62 may be disc-like. The annular press-fit portion may correspond to an outer circumference of the main body 61. A bush insertion hole 64, in which the bush 54 of the lower bearing 50 may be inserted, may be formed through a central portion of the support plate 62. Rivet coupling holes 65 corresponding to the rivet insertion holes 52*a* may be formed at an outside of the bush insertion hole 64. With the rivet insertion holes 52*a* and the rivet coupling holes 65 aligned with each other, the lower bearing 50 and the lower frame 60 may be fastened to each other by the rivets 16.

The annular press-fit portion 63 may define an annular wall, and its outer circumferential surface may define a surface that contacts an inner circumferential surface of the shell 10. A diameter of a circle defined by the outer circumferential surface of the press-fit portion 63 may be greater than an inner diameter of the shell 10. Accordingly, the lower frame 60 may be prevented from being separated from the shell 10 after the press-fit portion 63 contacts the inner surface of the shell 10. A press-fit limit portion 66, which may have the shape of a flange, may be formed on a lower end portion of the press-fit portion 63. The press-fit limit portion 66 may be disposed such that its upper surface 66*a* (see FIG. 5B) may contact the lower end portion of the shell 10, and serve to prevent the lower frame 60 from being press-fitted to the shell 10 more than a predetermined depth upon press-fitting the lower frame 60 to the shell 10. An outer diameter of the press-fit limit portion 66 may be smaller than an outer diameter of the shell 10 and greater than the inner diameter of the shell 10. That is, when the lower frame 60 is mounted in the shell 10, an outer circumferential portion of the press-fit limit portion 66 may not protrude outside of the shell 10.

The base 70 may be provided with a mounting portion 75, on which the lower frame 60 may be mounted. The mounting portion 75 may include a mounting surface 73 that contacts a lower surface 66*b* (see FIG. 5B) of the press-fit limit portion 66 of the lower frame 60, and an annular wall 74 that contacts a side surface of the press-fit limit portion 66. The annular wall 74 may have a taper shape, such that an inner diameter of the base 70 at the annular wall 70 decreases in a downward direction. An inner diameter of the base 70 at an upper end portion of the annular wall 74 may be greater than an outer diameter of the lower frame 60 at the press-fit limit portion 66, and an inner diameter of a lower end portion of the base 70 at the annular wall 74 may be equal to the outer diameter of the lower frame 60 at the press-fit limit portion 66.

Therefore, the base 70 and the lower frame 60 may be coupled to each other in position, as the lower portion of the press-fit limit portion 66 contacts the lower end portion of the annular wall 74. Also, an upper portion of the press-fit limit portion 66 may be spaced apart from the annular wall 74, so that a region between the lower end portion of the shell 10 and the upper end portion of the annular wall 74 may be exposed. The exposed upper portion of the press-fit limit portion 66 may be coupled to the shell 10 and the annular wall 74 upon welding. This may allow formation of a welded portion W (see FIGS. 5A-5B) at which the shell 10, the base 70, and the lower frame 60 are coupled by a single instance of welding. As the outer circumferential portion of the lower frame 60 at the press-fit limit portion 66 is internally spaced apart from the outer surface of the shell 10, the welded portion W may also contact the side surface of the press-fit limit portion 68, thereby increasing a coupling strength.

In one embodiment, the inner diameter of the base 70 along the entire annular wall 74 may be equal to the outer diameter of the lower frame 60 at the press-fit limit portion 66, such that the lower frame 60 may be mounted onto the base 70 more stably and the base 70 aligned with the shell 10 in a more stable manner during the welding process. In another embodiment, the inner diameter of the base 70 along the entire annular wall 74 may be greater than the outer diameter of the lower frame 60 at the press-fit limit portion 66, such that a range of the welded portion W between the shell 10 and the base 70 may be increased, thereby enhancing welding strength.

Figure 5A:
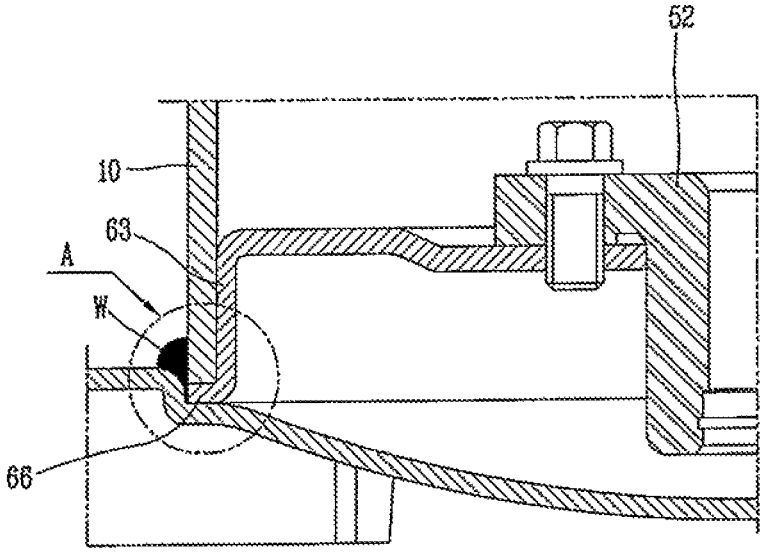
FIGS. 5A-5B are cross-sectional views showing the coupling structure of the shell, the lower frame, and the base of FIG. 2.
Figure 5B:
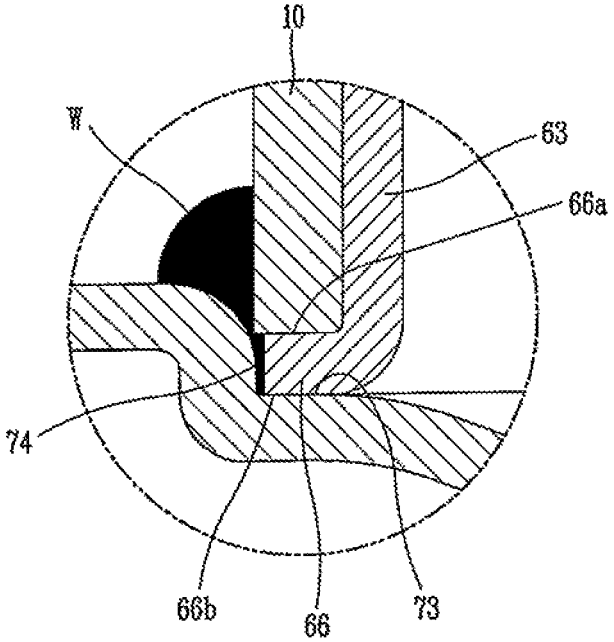

Hereinafter, description will be given of a process of manufacturing a compressor according to an embodiment with reference to FIGS. 5A-5B. A process of coupling the shell 10, the main frame 11, the stator 32, the second scroll 22, and the first scroll 24 may be executed by employing processes known in the related art, so description thereof has been omitted in this disclosure. After mounting the main frame 11 and the stator 32 in the shell 10 through known processes, the lower frame 60, the lower bearing 50, and the base 70 having the aforementioned shapes may be prepared, respectively.

The lower bearing 50 may then be fixed to the lower frame 60 using the rivets 16. The fixed structure may be mounted onto one machine tool to process an inner surface of the bush 54 of the lower bearing 50, namely, a bearing surface, and the press-fit portion 63 of the lower frame 60. The bearing surface and the press-fit portion 63 may be processed in a sequential manner or a simultaneous manner. However, simultaneously processing both of them may increase a processing speed and accuracy of a concentric processing for the bearing surface and the press-fit portion 63. The simultaneous processing of the two surfaces using one machine tool may result in a remarkable improvement of concentricity, as compared with conventional techniques of coupling the components after separately processing them.

Once the concentric processing of the lower bearing 50 and the lower frame 60 is completed, the lower frame 60 may be press-fitted into the lower end portion of the shell 10. During this process, the upper surface 66*a* of the press-fit limit portion 66 may be inserted to reach the lower end portion of the shell 10. Accordingly, the lower frame 60 may be coupled to the shell 10 with a predetermined press-fit depth. Also, the press-fit portion 63 may be coupled to the shell 10 by the press-fitting. This may allow alignment between the shell 10 and the lower frame 60 to be maintained during the coupling process. Accordingly, it may not be necessary to realign centers of the lower bearing 50 and the shell 10 with each other.

According to one embodiment, the lower surface 66*b* of the press-fit limit portion 66 and the mounting surface 73 of the base 70 may be processed to be flush with each other. Hence, when the lower surface 66*b* of the press-fit limit portion 66 is mounted onto the mounting surface 73 of the base 70 after the lower frame 60 is press-fitted, the two surfaces may contact in parallel to each other. In addition, as the lower end portion of the annular wall 74 contacts the outer circumferential portion of the base 70 at the press-fit limit portion 66, alignment of the base 70 and the shell 10 may be achieved merely by inserting the press-fit limit portion 66 into the annular wall 74. Through these processes, centers of the rotational shaft 40, the shell 10, and the lower bearing 50 may all be aligned. Accordingly, the base 70 may be coupled to the shell 10 by welding along the annular wall 74 and a circumference of the fewer end portion of the shell 10.

Figure 6:
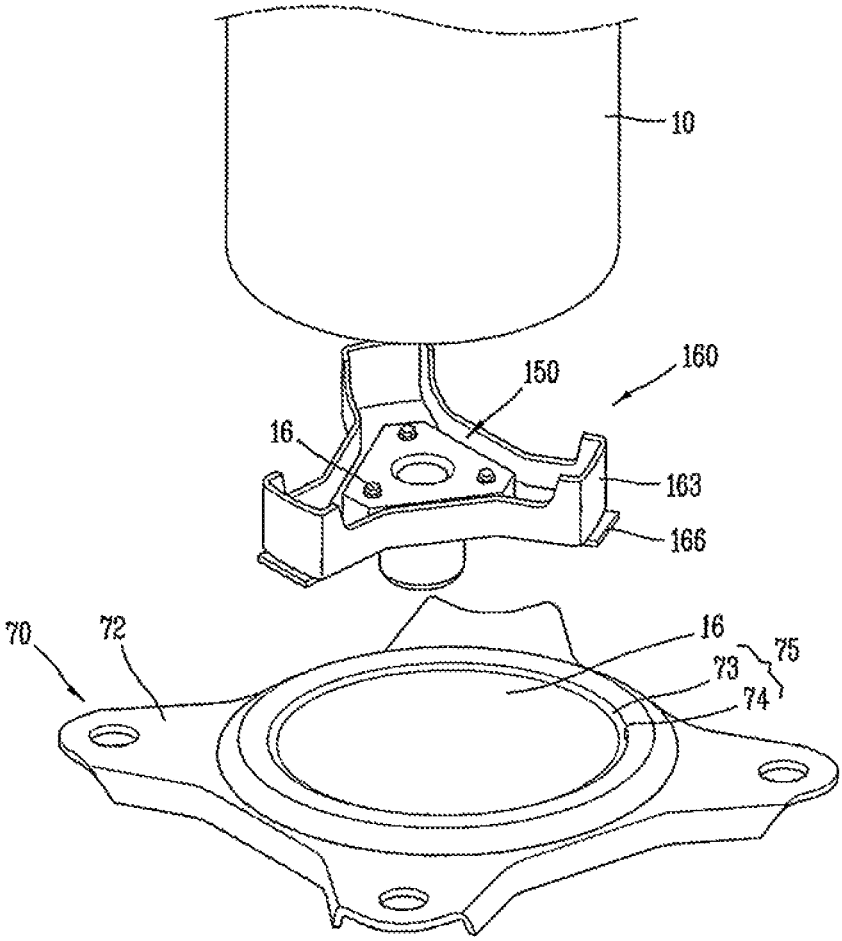
FIG. 6 is a disassembled perspective view of portions of a hermetic compressor in accordance with another embodiment.

According to one embodiment, the lower frame 60 may not be limited to the aforementioned shape, but rather, may employ a different shape. FIG. 6 is a disassembled perspective view of portions of a hermetic compressor in accordance with another embodiment. That is, FIG. 6 illustrates an exemplary variation of the lower frame 60. That is, the variation is different from the embodiment shown in FIG. 2 in that press-fit portions 163 may not be formed in a circular shape, but rather, formed to contact the inner wall of the shell at three positions. Here, a press-fit limit portion 166 may protrude from a lower end portion of each press-fit portion 163 to outside.

An assembly process of the embodiment shown in FIG. 6 may be the same as that of the embodiment shown in FIG. 2, and thus, repetitive description has been omitted. As discussed above, with a reduction in a contact area of the press-fit portion 166, the lower frame 160 may be press-fitted into the shell 10 with a smaller force. A press-fit strength may decrease due to the reduced contact area, but an appropriate press-fit strength may be ensured by way of increasing a length of the press-fit portion 166 in a vertical direction.

Embodiments disclosed herein provide a compressor having a lower frame and a method of manufacturing the same.

Embodiments disclosed herein provide a compressor that may include a cylindrical shell, a rotational shaft rotatably mounted in the cylindrical shell, a rotation part configured to rotate the rotational shaft, a compression part driven by the rotational shaft, a lower bearing configured to rotatably support one side of the rotational shaft, a lower frame configured to support the lower bearing, the lower frame being press-fitted into a lower end portion of the cylindrical shell, and a base configured to seal the lower end portion of the cylindrical shell. The lower frame may include a press-fit portion press-fitted onto an inner circumferential surface of the cylindrical shell and a press-fit limit portion disposed adjacent to the press-fit portion, the press-fit limit portion being configured to limit a press-fit depth by contacting the lower end portion of the cylindrical shell.

Embodiments disclosed herein provide a compressor that may include a cylindrical shell, a rotational shaft rotatably mounted in the shell, a rotational part configured to rotate the rotational shaft, a compression part driven by the rotational shaft, a lower bearing configured to rotatably support one side of the rotational shaft, a lower frame configured to support the lower bearing and press-fitted into a lower end portion of the cylindrical shell, and a base configured to seal the lower end portion of the cylindrical shell. The lower frame may include a press-fit portion or main body press-fitted onto an inner circumferential surface of the cylindrical shell, and a press-fit limit portion or flange disposed adjacent to the press-fit portion and configured to limit a press-fit depth by contacting the lower end portion of the cylindrical shell.

Biasing (for example, unbalancing, or inclination) of the lower frame caused during a welding process may be prevented by press-fitting the lower frame into the lower end portion of the shell. The lower frame may include a press-fit portion, and further include a press-fit limit portion to limit a press-fit length such that the lower frame may be press-fitted by a predetermined depth without a separate jig.

The press-fit limit portion may have a shape of a flange formed on an outer circumferential portion of the lower frame. A press-fit depth of the lower frame may be uniformly maintained by inserting the lower end portion of the shell to contact the surface of the flange. The press-fit limit portion may be located on a circumference of the lower end portion of the lower frame. The press-fit limit portion may be formed to protrude from a portion of an outer circumferential portion of the lower frame, like a flange.

An outer end portion of the lower frame at the press-fit limit portion may be located between outer and inner circumferential surfaces of the cylindrical shell. That is, the outer circumferential surface of the lower frame at the press-fit limit portion may be internally spaced apart from an outer surface of the shell. Therefore, a welded portion to couple the shell and the base may contact a side surface of the press-fit limit portion, thereby enhancing a coupling strength.

A mounting portion to mount the press-fit limit portion thereon may be formed on the base. The mounting portion may serve to guide the lower frame to align in position with the base.

The press-fit limit portion may have a shape of a flange formed on a circumference of the lower end portion of the lower frame. The mounting portion may include a mounting surface that contacts a lower surface of the flange and an annular wall that contacts the outer circumferential portion of the lower frame at the press-fit limit portion.

An inner diameter of the base at the annular wall may be greater than an outer diameter of the cylindrical shell. Accordingly, the outer circumferential portion of the lower frame at the press-fit limit portion may be exposed between the annular wall and the outer wall of the cylindrical shell. This may allow the base, the shell, and the lower frame to be fixed together by a single instance of welding.

The base and the cylindrical shell may be welded, such that the mounting surface and the lower end portion of the cylindrical shell may contact the press-fit limit portion, respectively. The press-fit portion of the lower frame may have a circumferential shape that contacts all or a portion of the inner circumferential surface of the cylindrical shell. This may allow the press-fit portion to contact the inner circumferential surface of the shell more stably and minimize deformation of the shell during welding of the shell and the base.

The lower bearing may include an inner circumferential surface to rotatably support the outer circumferential surface of the rotational shaft, and the inner circumferential surface may be concentric with the press-fit portion of the lower frame. Accordingly, the lower bearing may also be concentric merely by aligning the lower frame and the shell to be concentric with each other. The term "concentric" may be construed as meaning an existence of an air gap large enough to be generated in view of a processing technique, other than being physically completely concentric.

Embodiments disclosed herein provide a method for manufacturing a compressor that may include preparing a cylindrical shell, a lower bearing, a lower frame having a press-fit portion that contacts an inner circumferential surface of the cylindrical shell, and a base, coupling the lower bearing to the lower frame, such that a center of an inner circumferential surface of the lower bearing can be aligned with a center of the press-fit portion of the lower frame, press-fitting the lower frame into a lower end portion of the cylindrical shell, mounting the lower frame press-fitted in the cylindrical shell onto the base, and welding the lower end portion of the cylindrical shell and the base onto each other.

The lower frame may be press-fitted into the shell in a state in which the lower frame and the lower frame are concentric with each other. This may allow the lower frame to be coupled to the shell without being biased, and a separate task may not be required to align centers of the lower bearing and the shell.

The method may further include forming a press-fit limit portion adjacent to the press-fit portion. For the press-fitting of the lower frame, the lower frame may be press-fitted into the cylindrical shell until the press-fit limit portion contacts the lower end portion of the cylindrical shell. This may allow the lower frame to be press-fitted into the shell by a predetermined depth.

The press-fit limit portion may be formed in a shape of a flange on a lower end portion of the lower frame. The method may further include processing an upper surface of the press-fit limit portion to be substantially perpendicular to the rotational shaft. The upper surface of the press-fit limit portion may contact the lower end portion of the cylindrical shell. As the method may further include processing the upper surface to be substantially perpendicular to the rotational shaft, alignment of the lower frame may further be improved.

The press-fit portion and the inner circumferential surface of the lower bearing may be processed to be concentric with each other in a coupled state of the lower frame and the lower bearing. That is, instead of aligning the centers only after the separately processed lower frame and lower bearing are coupled, the lower bearing may first be aligned with the lower frame, and the inner surface of the lower bearing and the press-fit portion of the lower frame may be processed to easily align the centers with each other. The press-fit portion and the inner circumferential surface may be processed simultaneously. The method may further include forming a mounting portion on the base, such that the press-fit limit portion is mounted thereon. In addition, a position of the base with respect to the cylindrical shell may depend on mounting of the press-fit limit portion onto the mounting portion.

The lower frame may be prevented from being biased during a welding process by press-fitting the lower frame into the lower end portion of the shell. This may prevent noise and abrasion caused due to biasing of the rotational shaft, resulting in improvement of performance and reliability of the compressor.

In addition, with the formation of the press-fit limit portion, the lower frame may be press-fitted by a predetermined depth even without a separate jig. This may allow for simplification of a manufacturing process and constant maintenance of quality of the compressor.

The lower frame may be press-fitted into the shell where the lower frame and the lower bearing are kept to be concentric with each other. Accordingly, the lower frame may be coupled to the shell without being biased and an additional task to align centers of the lower bearing and the shell may not be required. This may result in simplifying the manufacturing process of the compressor and improving productivity of the compressor. Also, while the lower bearing is mounted to the lower frame, the inner surface of the lower bearing and the press-fit portion of the lower frame may be processed, such that their centers may be easily aligned with each other. This may result in further improvement of the productivity of the compressor.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for manufacturing a compressor, the method comprising;

providing a cylindrical shell, rotational shaft, a rotor, a stator, a compression device, a lower bearing, a lower frame, and a base:

mounting the rotational shaft to the compression device in the cylindrical shell, wherein the rotor and stator are configured to rotate the rotational shaft, and wherein the lower bearing support one side of the rotational shaft;

supporting the lower bearing with the tower frame, wherein the lower frame has a main body that contacts an inner circumferential surface of the cylindrical shell and a flange that extends from the main body;

coupling the lower bearing to the lower frame, such that a center of an inner circumferential surface of the lower bearing is aligned with a center of the main body of the lower frame;

press-fitting the lower frame into a lower end portion of the cylindrical shell until the flange contacts the lower end portion of the cylindrical shell;

mounting the lower frame press-fitted in the cylindrical shell onto the base to seal the lower end portion of the cylindrical shell, wherein the base has a mounting surface that contacts a lower surface of the flange and an annular wall that faces an outer circumferential surface of the flange; and welding the outer circumferential surface of the flange, an outer circumferential surface of the cylindrical shell, and an inner circumferential surface of the annular wall together.

2. The method for manufacturing the compressor of claim 1, where the flange extends from an outer circumferential portion of the main body.

3. The method for manufacturing the compressor of claim 2, wherein the flange extends from the outer circumferential portion of the main body at a lower end portion thereof.

4. The method for manufacturing the compressor of claim 2, wherein an outer end portion of the flange extends substantially between the outer circumferential surface and the inner circumferential surface of the cylindrical shell.

5. The method for manufacturing the compressor of claim 1, further comprising processing an upper surface of the flange to extend substantially perpendicular to the rotational shaft.

6. The method for manufacturing the compressor of claim 1, wherein the main body and the inner circumferential surface of the lower bearing are processed to be concentric with each other in a coupled state in which the lower frame and the lower bearing are fitted to each other.

7. The method for manufacturing the compressor of claim 6, wherein the main body and the inner circumferential surface of the lower bearing are processed in a simultaneous manner.

8. The method for manufacturing the compressor of claim 1, further comprising forming a mounting portion on the base such that the flange is mounted thereon.

9. The method for manufacturing the compressor of claim 8, wherein the mounting portion corresponds in shape to a shape of the lower frame.

10. The method for manufacturing the compressor of claim 8, wherein the flange extends from an outer circumferential portion of the main body at a lower end portion thereof, and wherein the mounting portion comprises the mounting surface that contacts the lower surface of the flange and the annular wall that contacts the outer circumferential portion of the flange.

11. The method for manufacturing the compressor of claim 10, wherein an inner diameter of the base at an upper portion of the annular wall is greater then an outer diameter of the cylindrical shell.

12. The method for manufacturing the compressor of claim 8, wherein a portion of the base with respect to cylindrical shell depend on mounting of the flange onto the mounting portion.

13. The method for manufacturing the compressor of claim 1, wherein an outer circumferential surface of the main body contacts all or a portion of the inner circumferential surface of the cylindrical shell after the press-fitting.

14. The method for manufacturing the compressor of claim 1, wherein the lower bearing comprises an inner circumferential surface that rotatably supports an outer circumferential surface of the rotational shaft, and wherein the inner circumferential surface and the flange of the lower frame are concentric with each other after the mounting.

15. A method for manufacturing a compressor, the method comprising:

providing a cylindrical shell, a rotational shaft, a stator, a compression device, a lower bearing, a lower frame, and a base;

mounting the rotational shaft to the compression device in the cylindrical shell, wherein the rotor and stator are configured to rotate the rotational shaft, and wherein the lower bearing supports one side of the rotational shaft;

supporting the lower bearing with the lower frame, wherein the lower frame has a main body that contacts an inner circumferential surface of the cylindrical shell and a flange that extends from the main body;

coupling the lower bearing to the lower frame, such that a center of an inner circumferential surface of the lower bearing is aligned with a center of the main body of the lower frame;

press-fitting the lower frame into a lower end portion of the cylindrical shell until the flange contacts the lower end portion of the cylindrical shell;

mounting the lower frame press-fitted in the cylindrical shell onto t he base to seal the lower end portion of the cylinder shell, wherein the base has a mounting surface that contacts a lower surface of the flange and an annular wall that is spaced apart from the entire outer circumferential surface of the shell; and welding the outer circumferential surface of the flange, an outer circumferential surface of the cylindrical shell, and an inner circumferential surface of the annular wall together.

16. The method for manufacturing the compressor of claim 15, wherein the flange extends from an outer circumferential portion of the main body.

17. The method for manufacturing the compressor of claim 15, further including processing an upper surface of the flange to extend substantially perpendicular to the rotational shaft.

18. The method for manufacturing the compressor of claim 15, wherein the main body and the inner circumferential surface of the lower bearing are concentric with each other in a coupled state in which the lower frame and the lower bearing are fitted to each other.

19. The method for manufacturing the compressor of claim 15, further including forming a mounting portion on the base such that the flange is mounted thereon.

20. The method for manufacturing the compressor of claim 15, wherein an outer circumferential surface of the main body contacts all or a portion of an inner circumferential surface of the cylindrical shell after the press-fitting.

* * * * *